United States Patent [19]

Pinson

[11] Patent Number: 4,838,502

[45] Date of Patent: Jun. 13, 1989

[54] RESILIENTLY DEPLOYABLE FAIRING FOR SEALING AN AIRFRAME CAVITY

[75] Inventor: George T. Pinson, Huntsville, Ala.

[73] Assignee: The Boeing Company, Seattle, Wash.

[21] Appl. No.: 169,223

[22] Filed: Mar. 16, 1988

[51] Int. Cl.[4] ..... F42B 13/32

[52] U.S. Cl. ..... 244/49; 244/326; 244/327; 244/130

[58] Field of Search ..... 244/3.25, 3.26, 3.27, 244/49, 91, 130

[56] References Cited

U.S. PATENT DOCUMENTS

| | | | |
|---|---|---|---|
| 3,356,317 | 12/1967 | Bird . | |
| 3,837,577 | 9/1974 | Presz | 244/130 |
| 4,007,896 | 2/1977 | Reynolds, III | 244/130 |
| 4,568,044 | 2/1986 | DiTommaso et al. | 244/49 |
| 4,640,477 | 2/1987 | Pace . | |

FOREIGN PATENT DOCUMENTS

| | | | |
|---|---|---|---|
| 2089334 | 1/1972 | France | 244/3.28 |

*Primary Examiner*—Sherman D. Basinger
*Assistant Examiner*—Thomas J. Brahan
*Attorney, Agent, or Firm*—Finnegan, Henderson, Farabow, Garrett & Dunner

[57] ABSTRACT

A cavity in an airframe from which an airfoil is deployed is automatically closed to reduce aerodynamic drag by a fairing element hinged to the force and aft cavity edges and resiliently deformable from an unbent aerodynamic position outside the cavity to a bent position within the cavity. The non-deployed airfoil overlies the bent fairing element and retains the fairing in a bent position against the resilient force tending to restore it to the unbent position, until airfoil deployment.

10 Claims, 3 Drawing Sheets

RESILIENTLY DEPLOYABLE FAIRING FOR SEALING AN AIRFRAME CAVITY

BACKGROUND OF THE INVENTION

1. Field of the Invention

The present invention relates to devices for sealing cavities in airframes through which control surfaces are deployed and for reducing aerodynamic drag effects by reducing airframe discontinuities after the control surfaces are deployed.

2. Background of the Invention

Missiles, projectiles and other airframes that use deployable fins, wings, strakes, canards and other deployable flight control surfaces have increased aerodynamic drag in the deployed state as compared with airframes that use fixed control elements. Current deployment methods and apparatus generally do not include techniques for reducing the drag after the control surfaces are released in order to minimize the mechanical complexity thereby improving the reliability of the system.

Three constructions which have been used with some success to reduce drag while maintaining the body cross-sectional area essentially constant when the surfaces are in the retracted state, are 1. Folding of surface into the main airframe body through slots in the airframe skin, 2. Folding of surface into flattened areas on the outside of the main airframe body, and 3. Wrapping of surfaces around the airframe body in shaped reliefs.

FIGS. 1A–1D illustrate a prior art design where a deployable body is folded into a slot. As depicted, deployable surfaces (a) are housed prior to deployment in slot (d) cut into the body of the airframe (b) defined by external skin (c). Hinge cutouts (e) may be used to provide room for hinge (f) after the deployable surface (a) is released. Slots (d) usually remain open after deployment (see FIG. 1D) thereby constituting a source of aerodynamic drag that affects the flight characteristics of airframe (b).

FIGS. 2A–2C illustrate another prior art design where a deployable aerodynamic surface is folded into flattened areas on the outside skin. In this design, recesses or flats (h) are provided such that the deployable surface (a) is within the projected cross section of the airframe when in the non-deployed state (FIG. 2B). When the fins or other deployable control surfaces (a) are deployed, flats (h) remain open thereby disrupting the airflow as it passes over the airframe skin (c).

FIGS. 3A–3C illustrate a third construction characteristic of the prior art for deployable control surfaces using wraparound fins or surfaces. As seen best in FIGS. 3B and 3C, aerodynamic surfaces (a) unwrap leaving recesses (i) on the airframe (b) thereby disrupting airflow.

All of the above-described constructions fail to provide a continuous smooth airframe after the aerodynamic surfaces are deployed. These airframe discontinuities disrupt the airflow thereby inducing turbulence and increasing drag. The turbulent airflow in the vicinity of the control surfaces can further reduce control system effectiveness.

Other prior art constructions have attempted to use movable panels to close the slots or other openings after deployment of the fins or other control surfaces. U.S. Pat. No. 4,007,896 to Reynolds and U.S. Pat. No. 4,640,477 to Pace are representative in that both use closure panels which are hinged at one end to the airframe body and utilize springs to move the panels to a sealing position following deployment. However, these constructions have not been entirely successful due to the added complexity caused by the separate spring element and the inability to consistently provide adequate sealing engagement between the non-hinged panel end and the airplane skin.

SUMMARY OF THE INVENTION

In accordance with the invention, as embodied and broadly described herein, the apparatus for sealing a cavity in an airframe through which an airfoil has been deployed, the skin of the airframe defining fore and aft edges of the cavity relative to the intended direction of motion of the airframe, comprises a fairing element having a longitudinal axis with opposed fairing axial ends, the fairing being resilient to bending along the longitudinal axis, and means for attaching the fairing axial ends to the cavity fore and aft edges, respectively. The attached fairing element has an unbent state and a bent state and, in the unbent state, is in a position to provide to the flow of air past the airframe, an aerodynamically shaped transition between the skin portions fore and aft of the cavity. The attached fairing element in the bent state is positioned substantially within the cavity and has a continuous resilient bias toward the unbent position. Additionally, means are provided for retaining the fairing member in the bent state against the bias until deployment of the airfoil and then releasing the fairing member for movement to the unbent state. A thin sheet of spring steel is a preferred fairing element although other materials with a resilient bias may be used as well, such as various titanium alloys, 7075-76 aluminum, and certain materials containing carbon, Kelvar, glass and boron filaments. Depending upon the contruction of the airframe, these other materials may be preferred whenever dissimilar materials are to be avoided.

Preferably, the attaching means includes fore and aft fairing joints rigidly attaching the fairing element axial ends to the respective cavity edges, wherein the joints are continuous sealed joints extending across the total fore and aft edge width transverse to the intended airframe motion direction.

It is also preferred that, in the bent state, the fairing element is received within the cavity an amount sufficient to permit storage of the undeployed airfoil overlying the bent fairing element, and wherein the retaining and releasing means include the stored overlying airfoil being configured and positioned to restrainingly contact the bent fairing member while undeployed and to be free of the fairing element when deployed.

The accompanying drawings which are incorporated in and constitute a part of this specification, illustrate one embodiment of the invention and, together with the description, served to explain the principles of the invention.

Reference will now be made in detail to the present preferred embodiment of the invention, an example of which is illustrated in the above-described drawings.

DESCRIPTION OF THE PREFERRED EMBODIMENT

Figure 1A:
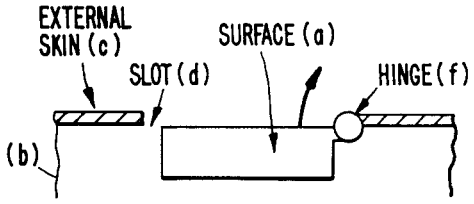
FIG. 1A. (PRIOR ART)
FIGS. 1A–1D depict a conventional airframe construction having deployable control surfaces.
Figure 1B:
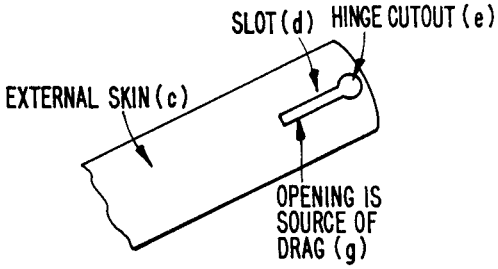
FIG. 1B. (PRIOR ART)
Figure 1C:
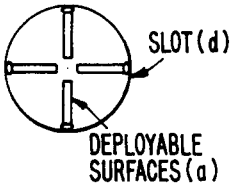
FIG. 1C. (PRIOR ART)
Figure 1D:
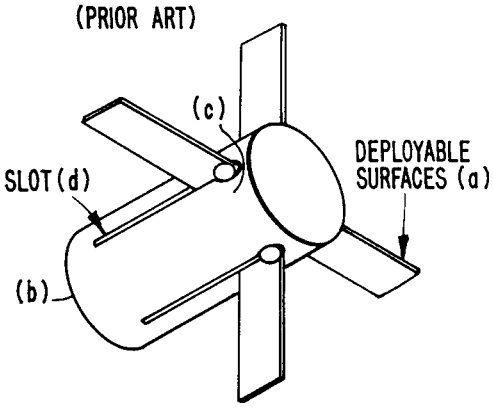
FIG. 1D. (PRIOR ART)
Figure 2A:
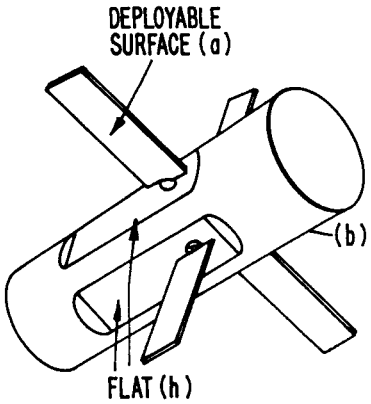
FIG. 2A. (PRIOR ART)
FIGS. 2A–2C depict another conventional airframe construction with deployable control surfaces.
Figure 2B:
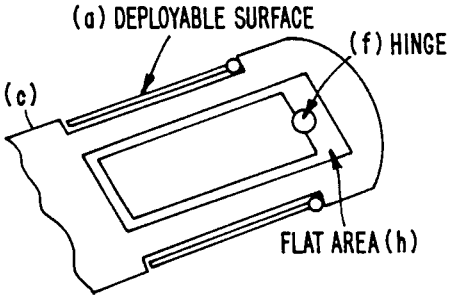
FIG. 2B. (PRIOR ART)
Figure 2C:
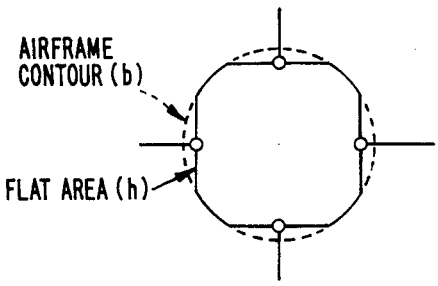
FIG. 2C. (PRIOR ART)
Figure 3A:
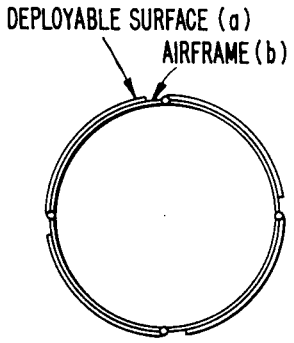
FIG. 3A. (PRIOR ART)
FIGS. 3A–3C depict yet another conventional airframe construction using deployable control surfaces.
Figure 3B:
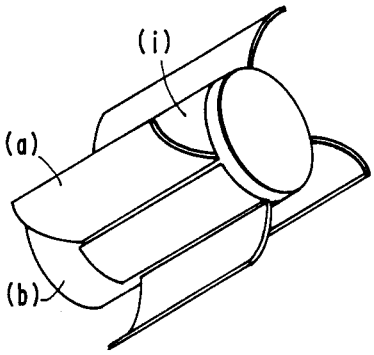
FIG. 3B. (PRIOR ART)
Figure 3C:
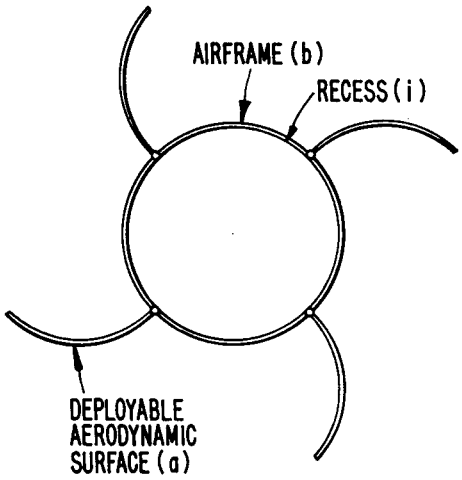
FIG. 3C. (PRIOR ART)
Figure 4A:
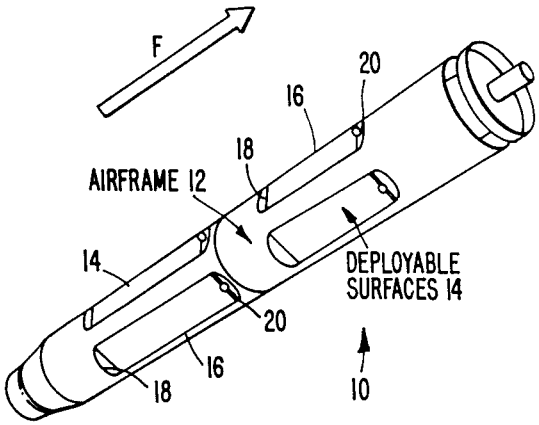
FIGS. 4A–4B are a perspective schematic representation of the cavity sealing apparatus made in accordance with the present invention shown in use on a missile airframe with the missile airfoils in a non-deployable and a deployable state, respectively.
Figure 4B:
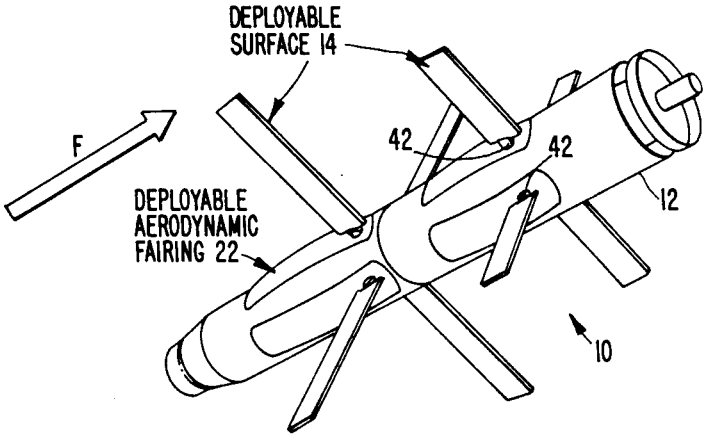

FIGS. 4A and 4B depict the preferred embodiment of the present invention which is designated generally by the numeral 10 and is shown in use on missile airframe 12 having a plurality of deployable surfaces, namely airfoils 14. FIG. 4A depicts airfoils 14 in the non-deployed state positioned in cavities 16 in airframe 12, while FIG. 4B shows airfoils 14 deployed and cavities 16 sealed by the apparatus 10 as will be discussed in further detail henceforth. Each of cavities 16 has fore and aft edges 18, 20, respectively, relative to the intended airflow direction designated by the letter F in the Figures.

Figure 5A:
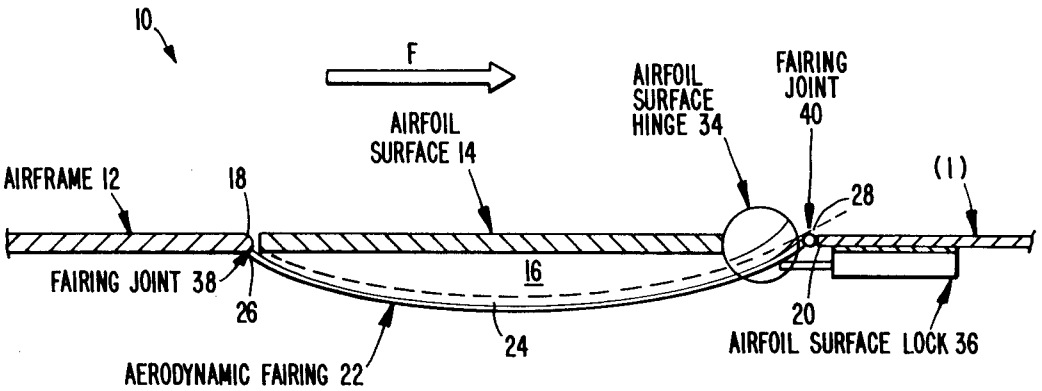
FIGS. 5A and 5B are detail cross-sections of the apparatus shown in FIGS. 4A and 4B, respectively.
Figure 5B:
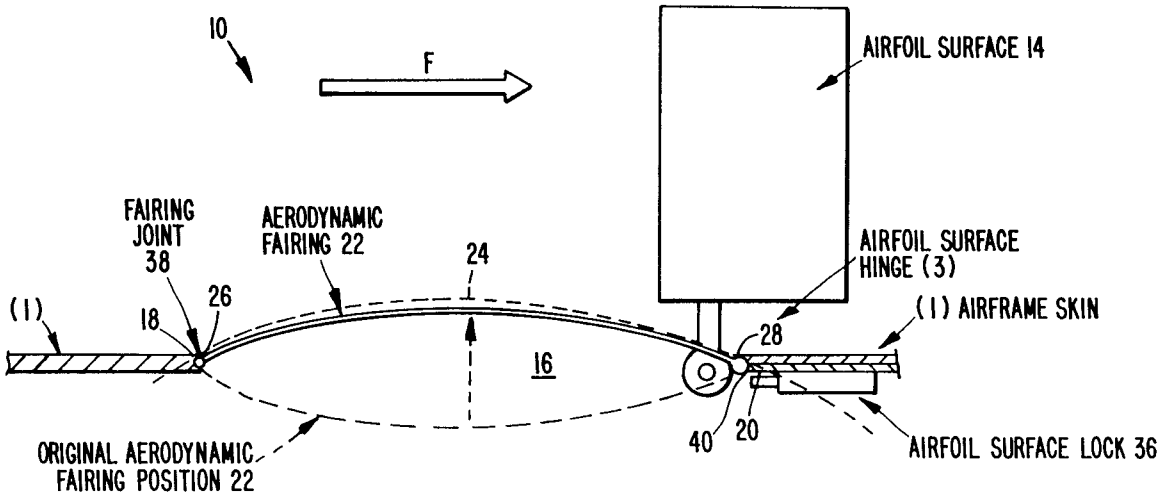

In accordance with the invention, the apparatus for sealing a cavity in an airframe through which an airfoil has been deployed includes a fairing element having a longitudinal axis with opposed fairing axial ends. As embodied herein, and with reference to FIGS. 5A and 5B which show apparatus 10 in cross-section detail in the non-deployed and deployed states, respectively, apparatus 10 includes fairing element 22 having a longitudinal axis 24 (shown dotted and separated from element 22 for clarity) along the flow direction F. Fairing element 22 includes opposed axial ends 26, 28. Fairing element 22 is shown positioned in cavity 16 of airframe 12 between fore and aft cavity edges 18, 20 respectively. Airfoil surface 14 is attached to airframe 12 by a hinge/actuator assembly 34 and is held in cavity 16 in the non-deployed state (FIG. 5A) by lock 36. Upon deployment, airfoil 4 swings into flow stream F and away from both cavity 16 and fairing element 22 (FIG. 5B). The details of hinge 34 and lock 36 are not provided since the subject invention will work for any folded or wrap-around control surface mechanism usable with the conventional deployable airfoil constructions previously illustrated in FIGS. 2A–2C and 3A–3C.

Importantly, the fairing of the present invention element is resilient to bending along the longitudinal axis, that is, has an internal biasing force tending to restore it to the unbent state and position without the imposition of a separate, external force. As depicted in FIGS. 5A and 5B, fairing element 22 is shown in the bent state in FIG. 5A, shaped concave outward relative to the location of the airstream F, and convex outward in the unbent or relaxed state in FIG. 5B to achieve an aerodynamic shape in the direction of flow F. Fairing element 22 preferably is made from sheet spring steel, but other resilient materials may be substituted provided that the material assumes the desired unbent aerodynamic shape as a result of the internal resiliency of the material.

Further in accordance with the present invention, the apparatus includes means for attaching the fairing axial ends to the cavity fore and aft edges. As embodied herein, and with continued reference to FIGS. 5A and 5B, there are provided fore and aft fairing joints 38, 40 respectively. Fairing joint 38 provides attachment between fairing end 26 and cavity edge 18, while fairing joint 40 attaches fairing end 28 to cavity edge 20. One skilled in the art would understand how to construct fairing joints 38, 40 to achieve an unbent position as shown in FIG. 5B, such as by welding with fairing ends 26,28 inclined to the unbent position. Preferably, fairing element 22 and joints 38, 40 extend transversely across the full widths of cavity edges 18, 20 and be continuously sealed to minimize flow discontinuities in the airframe cross section.

Further in accordance with the invention, the apparatus includes means for retaining the fairing element in the bent state against the bias of the fairing material resiliency until deployment of the airfoil and then releasing the fairing element for movement to the unbent state. As embodied herein, and with reference again to FIGS. 5A and 5B, airfoil 14 is positioned to overlie fairing member 22 in cavity 16 in the non-deployed state. In the present embodiment, airfoil 14 also acts to restrainingly contact and thereby constrain fairing member 22 in the bent state until deployment. One skilled in the art would realize that, alternatively, airfoil hinge assembly 34 could be configured to contact fairing element 22 to restrain that element in the bent state. FIG. 4B shows apertures 42 in the aft ends of fairings 22 to allow actuation of airfoils 14 through hinge assembly 34 in the deployed state.

It will be apparent to those skilled in the art that various modifications and variations could be made in the structure of the invention without departing from the scope or spirit of the invention.

What is claimed is:

1. Apparatus for sealing a cavity in an airframe through which an airfoil has been deployed, the skin of the airframe defining fore and aft edges of the cavity relative to the intended direction of motion of the airframe, the apparatus comprising:

a fairing element having a longitudinal axis with opposed fairing axial ends, said fairing being resilient to bending along said longitudinal axis;

means for attaching said fairing axial ends to the cavity fore and aft edges, respectively, said attached fairing element having an unbent state and a bent state, wherein said attached fairing in said unbent state is positioned to provide to the flow of air past the airframe, an aerodynamically shaped transition between the skin portions fore and aft of the cavity, wherein said attached fairing element in said bent state is positioned substantially within said cavity and has a continuous resilient bias toward said unbent position; and means for retaining said fairing member in said bent state against said bias until deployment of the airfoil and then releasing said fairing member for movement to said unbent state.

2. The apparatus as in claim 1 wherein said fairing element is a thin sheet of spring steel.

3. The apparatus as in claim 1 wherein the cross-sectional profile of said fairing element along said longitudinal axis in said unbent state is convex outward with respect to the cavity.

4. The apparatus as in claim 1 wherein said attaching means includes fore and aft fairing joints rigidly attaching said fairing element axial ends to the respective cavity edges.

5. The apparatus as in claim 4 wherein said joints are continuous sealed joints extending across the total fore and aft edge width transverse to the intended airframe motion direction.

6. The apparatus as in claim 1 wherein in said bent state, said fairing element is received within the cavity an amount sufficient to permit storage of the undeployed airfoil overlying said bent fairing element.

7. The apparatus as in claim 6 wherein said retaining and releasing means includes the stored overlying airfoil being configured and positioned to restrainingly contact said bent fairing member while undeployed and to be free of said fairing element when deployed.

8. The apparatus as in claim 7 wherein the airfoil is attached to the airframe by a hinge assembly, and wherein said fairing member includes an aperture through which the hinge assembly extends.

9. Apparatus for sealing a cavity in an airframe through which an airfoil has been deployed, the skin of the airframe defining fore and aft edges of the cavity relative to the intended direction of motion of the airframe, the apparatus comprising:

a fairing element having a longitudinal axis with opposed fairing axial ends, said fairing being resilient to bending along said longitudinal axis;

means for attaching said fairing axial ends to the cavity fore and aft edges, respectively, said attached fairing element having an unbent state and a bent state, and wherein the cross-sectional profile of said fairing element along said longitudinal axis in said unbent state is concave outward with respect to the cavity, and wherein said attaching means includes fore and aft fairing joints rigidly attaching said fairing element axial ends to the respective cavity edges, and wherein in said bent state said fairing element is received within the cavity an amount sufficient to permit storage of the undeployed airfoil overlying said bent fairing element, wherein said attached fairing in said unbent state is positioned substantially outside the cavity and provides to the flow of air past the airframe, an aerodynamically shaped transition between the skin portions fore and aft of the cavity, wherein said attached fairing element in said bent state is positioned substantially within said cavity and has a continuous resilient bias toward said unbent state; and means for retaining said fairing member in said bent state against said bias until deployment of the airfoil and then releasing said fairing member for movement to said unbent state.

10. The apparatus as in claim 9 wherein said retaining and releasing means includes the stored overlying airfoil being configured and positioned to restrainingly contact said bent fairing member while undeployed and to be free of said fairing element when deployed.

* * * * *